US008973686B2

(12) United States Patent
Dolan et al.

(10) Patent No.: US 8,973,686 B2
(45) Date of Patent: Mar. 10, 2015

(54) SUPER-HARD CUTTER INSERTS AND TOOLS

(75) Inventors: Gerald Dolan, Spring, TX (US); John Hewitt Liversage, Springs (ZA); Habib Saridikmen, Springs (ZA); Richard Bodkin, Springs (ZA); Mehmet Serdar Ozbayraktar, Springs (ZA)

(73) Assignees: Element Six Limited (IE); Element Six Abrasives S.A. (LU)

( * ) Notice: Subject to any disclaimer, the term of this patent is extended or adjusted under 35 U.S.C. 154(b) by 243 days.

(21) Appl. No.: 12/947,030

(22) Filed: Nov. 16, 2010

(65) Prior Publication Data

US 2011/0114393 A1 May 19, 2011

Related U.S. Application Data

(60) Provisional application No. 61/261,650, filed on Nov. 16, 2009.

(51) Int. Cl.
*E21B 10/36* (2006.01)
*E21B 10/633* (2006.01)
*E21B 10/56* (2006.01)

(52) U.S. Cl.
CPC ..... *E21B 10/633* (2013.01); *E21B 2010/566* (2013.01)
USPC ..... 175/428; 407/107; 407/112

(58) Field of Classification Search
None
See application file for complete search history.

(56) References Cited

U.S. PATENT DOCUMENTS

| | | | | | |
|---|---|---|---|---|---|
| 2,791,825 | A | * | 5/1957 | Greenleaf | 407/77 |
| 3,731,356 | A | * | 5/1973 | Gowanlock | 407/5 |
| 3,997,951 | A | * | 12/1976 | Williscraft | 407/105 |
| 4,286,901 | A | * | 9/1981 | Eckle | 407/109 |
| 4,382,477 | A | | 5/1983 | Barr | |
| 5,301,913 | A | * | 4/1994 | Wheatley | 248/231.41 |

(Continued)

FOREIGN PATENT DOCUMENTS

| | | | |
|---|---|---|---|
| EP | 81775 | A2 * | 6/1983 |
| EP | 0 974 566 | A1 | 1/2000 |

(Continued)

OTHER PUBLICATIONS

Santhanam, A.T. and P. Tierney, Cemented Carbides, ASM Handbook: vol. 16: Machining, ASM International, 1989, p. 71-89.*

(Continued)

*Primary Examiner* — Jennifer H Gay
*Assistant Examiner* — Caroline Butcher
(74) *Attorney, Agent, or Firm* — Bryan Cave LLP

(57) ABSTRACT

A cutter insert assembly for a drill bit for boring into the earth, comprising a super-hard structure clampable to a support body by means of a clamp mechanism; the clamp mechanism comprising opposed or opposable compression members connected or connectable by a tension member capable of sustaining a clamping force between the compression members when the cutter insert assembly is in a clamped condition, in which condition the compression members exert opposing compressive forces on the super-hard structure and the support body, operable to clamp the super-hard structure to the support body, and in which condition the cutter insert assembly is self-supporting and capable of being mounted onto a drill bit body.

18 Claims, 9 Drawing Sheets

(56) References Cited

U.S. PATENT DOCUMENTS

| | | | | |
|---|---|---|---|---|
| 7,163,360 | B2 * | 1/2007 | Toyose | 407/36 |
| 7,533,740 | B2 | 5/2009 | Zhang et al. | |
| 7,942,218 | B2 * | 5/2011 | Cooley et al. | 175/432 |
| 8,109,699 | B2 * | 2/2012 | Chen | 407/46 |
| 2006/0162969 | A1 * | 7/2006 | Belnap et al. | 175/433 |
| 2007/0278017 | A1 * | 12/2007 | Shen et al. | 175/426 |
| 2008/0308321 | A1 * | 12/2008 | Aliko et al. | 175/431 |

FOREIGN PATENT DOCUMENTS

| | | | |
|---|---|---|---|
| WO | 2007/020518 | A1 | 2/2007 |
| WO | WO 2007020518 | A1 * | 2/2007 |
| WO | 2007/110770 | A2 | 10/2007 |
| WO | WO 2008096314 | A2 * | 8/2008 |

OTHER PUBLICATIONS

Heath, P.J. Ultrahard Tool Materials, ASM handbook, vol. 16: Machining, ASM International, 1989, p. 105-117.*

Definition of Clamp by the Free Online Dictionary, Thesaurus and Encylclopedia, the American Heritage Dictionary of the English Language, Houghton Mifflin Company, Fourth Edition, 2000, updated 2009.*

Underwood, E.E., "Quantitative Stereography," Addison-Wesley, Reading, MA, (1970).

German, R.M., "The Contiguity of Liquid Phase Sintered Microstructures," Metallurgical Transactions A, 16A, Jul. 1985, 1247-1252.

* cited by examiner

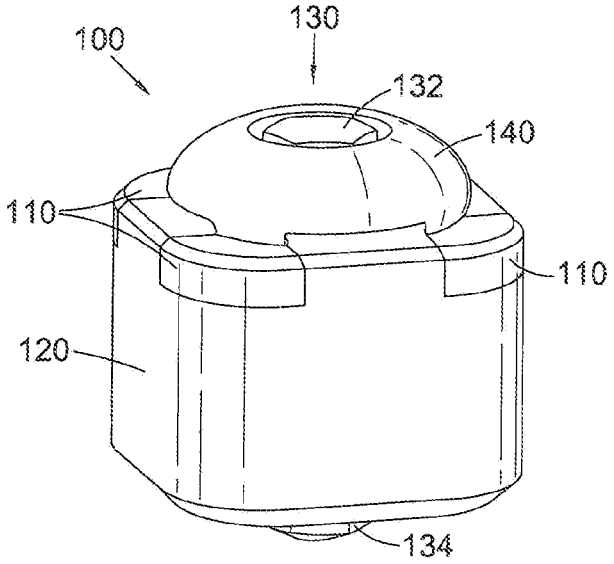
Fig. 6
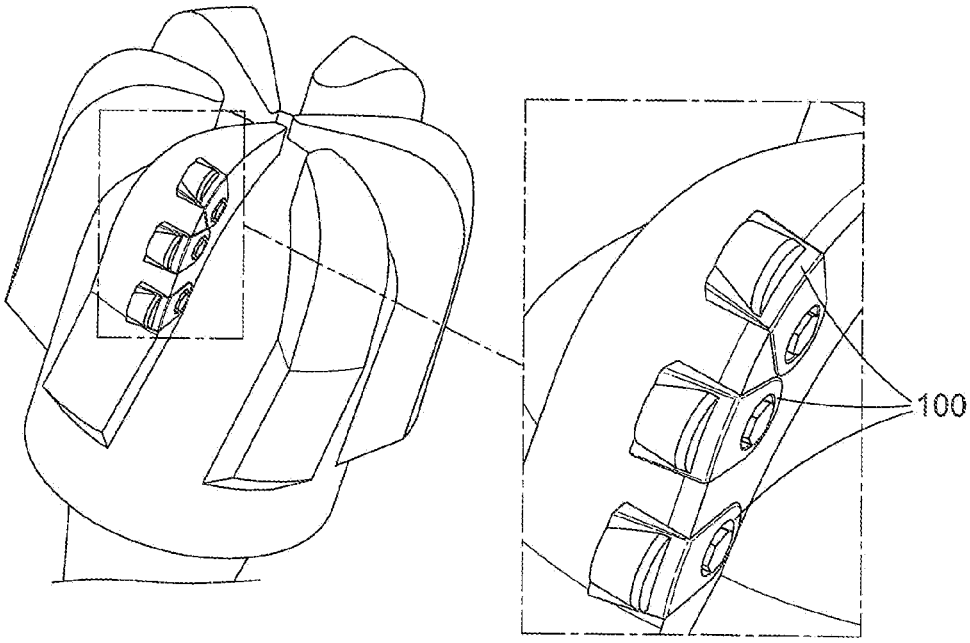
Fig. 7A
Fig. 7B

SUPER-HARD CUTTER INSERTS AND TOOLS

This application claims the benefit of U.S. Provisional Application No. 61/261,650, filed Nov. 16, 2009, the disclosure of which is incorporated herein by reference in its entirety.

FIELD

Embodiments of the invention relate generally to super-hard cutter inserts, particularly for drill bits for boring into the earth, and tools comprising same.

BACKGROUND

Polycrystalline diamond (PCD) material and polycrystalline cubic boron nitride (PCBN) material are examples of polycrystalline super-hard materials. As used herein, super-hard materials have a Vickers hardness of at least about 28 GPa.

PCD material comprises a mass of substantially inter-grown diamond grains and interstices between the diamond grains. PCD may be made by subjecting an aggregated mass of diamond grains to an ultra-high pressure and temperature in the presence of a sintering aid such as cobalt, which may promote the inter-growth of diamond grains. The sintering aid may also be referred to as a catalyst material for diamond. Interstices within the PCD material may be wholly or partially filled with residual catalyst material. PCD may typically be integrally formed on and bonded to a cobalt-cemented tungsten carbide substrate, which may provide a source of cobalt catalyst material for sintering the PCD. Tool inserts comprising PCD material are widely used in drill bits used for boring into the earth in the oil and gas drilling industry. Various grades of PCD having various compositions and microstructure are known and important properties such as the Young's modulus and strength of the PCD material may depend on its composition and microstructure, including the size distribution, homogeneity and contiguity of the diamond grains of which the PCD material is comprised. In practice, the grade of PCD produced may be constrained by the composition and micro-structural characteristics of the carbide substrate on which it is formed.

U.S. Pat. No. 7,533,740 discloses a cutting element in which thermally stable PCD layer is mechanically locked to a substrate. U.S. Pat. No. 4,382,477 discloses a support stud assembly mounted onto a drill bit, in which a hard preform is held to a support stud by means of a peg and a leaf spring.

There is a need to provide robust cutter inserts particularly but not exclusively for drill bits for boring into rock, permitting flexibility in the combination of various grades or configurations of super-hard structures and support substrates.

SUMMARY

Embodiments of the invention provide a cutter insert assembly for a drill bit for boring into the earth, comprising a super-hard structure clampable to a support body by means of a clamp mechanism; the clamp mechanism comprising opposed or opposable compression members connected or connectable to each other by a tension member capable of sustaining a clamping force between the compression members when the cutter insert assembly is in a clamped condition, in which condition the compression members exert opposing compressive forces on the super-hard structure and the support body, operable to clamp the super-hard structure to the support body, and in which condition the cutter insert assembly is self-supporting and capable of being mounted onto a drill bit body.

Embodiments of the invention provide a cutter insert for a drill bit, consisting of an embodiment of a cutter insert assembly according to the invention, in the clamped condition.

In one embodiment of the invention, at least part of the clamp mechanism, such as the tension member, may be disposed within an internal passage within the support body. In one embodiment of the invention, at least part of the clamp mechanism may be disposed within an internal passage or cavity defined cooperatively by the super-hard structure and the support body.

In one embodiment of the invention, the cutter insert may be releasably mountable or mounted onto a drill bit body and is self-supportable or self-supporting when dismounted from the drill bit body.

In one embodiment of the invention, the super-hard structure may be releasably clampable or releasably clamped to the support body by a releasable clamp mechanism, the super-hard structure being removable from the cutter insert responsive to release of the clamp mechanism.

In one embodiment of the invention, the clamp mechanism may comprise an elongate longitudinal tension member having a pair of opposite ends, and a pair of opposing or opposable laterally projecting compression members, each of which may be fixed, fastened or fastenable to a respective end. In one version of this embodiment, the tension member and at least one of the laterally extending compression members may be provided with cooperative inter-engagement means, such as threading.

In one embodiment of the invention, the clamp mechanism may comprise a pin provided with a pair of opposing ridges or lips connected by a shaft or neck, the opposing ridges or lips capable of functioning as the opposing compression members and the shaft or neck capable of functioning as the tension member.

In one embodiment of the invention, the clamp mechanism may comprise a shaft bearing a plurality of laterally extending ridges, capable of functioning as compression members. As a non-limiting example, the ridges may be formed by threading of a tension member in the general form of a shaft.

In one embodiment of the invention, a compression member may be brazed to support body.

In one embodiment of the invention, the cutter insert may comprise an intermediate compression member disposed between a compression member and the super-hard structure, for transmitting a compressive force generated by compression member onto the super-hard structure. The tension member may be disposed within an internal passage formed cooperatively by respective holes within the intermediate compression member and the support body.

In one embodiment of the invention, the compression member or intermediate compression member on the rake face of the cutter insert may comprise a material having relatively high wear and erosion resistance and hardness, and in one embodiment of the invention, the compression member or intermediate compression member on the rake face may comprise a material having hardness of at least about 60 HRA Rockwell hardness. In one embodiment, the compression member or the intermediate compression member may comprise carbide material, such as cemented carbide material, and in one embodiment, the compression member or intermediate compression member on the rake face may comprise a hard-facing layer of a wear resistant material, for example a sprayed layer of carbide material, or a super-alloy material. In one embodiment, a wear resistant element comprising a hard or super-hard material, such as PCD or PCBN, may be attached to the cutter insert over the compression member on the rake face to protect it against wear in use. Such embodiments may have the advantage that the compression member is protected from wear in use, thereby prolonging the working life of the cutter insert.

In one embodiment of the invention, the super-hard structure and the support body may be cooperatively configured to resist or prevent rotation of the super-hard structure relative to the support body when in the clamped condition and in use. In some embodiments, corresponding surfaces of the super-hard structure and the support body may be non-planar, provided with cooperating ridges, projections and recesses, for example, or may be substantially planar and offset from a plane of rotation.

In one embodiment of the invention, two or more super-hard structures may be clamped or clampable to the support body by means of a clamp mechanism, in which a compression member or intermediate compression member is configured to be capable of clamping the two or more super-hard structures simultaneously. The two or more super-hard structures may be spaced apart from each other when in the clamped condition. In one embodiment, the support body may be provided with two or more pockets or recesses to accommodate the respective super-hard structures. In some embodiments of the invention, the cutter insert may comprise two, three or four super-hard structures disposed within respective pockets formed at edges of the support body, and a compression member or an intermediate compression member configured and having sufficient extent to cover and clamp at least part of each of the super-hard structures when in the clamped condition.

Preferably the super-hard structure comprises polycrystalline diamond (PCD) material. Preferably the PCD material has a mean Young's modulus of at least about 900 GPa, at least about 1,050 GPa or at least about 1,100 GPa. In some embodiments of the invention, the PCD material may have transverse rupture strength of at least about 900 MPa, at least about 950 MPa, at least about 1,000 MPa, at least about 1,050 MPa, or even at least about 1,100 MPa. Embodiments of the invention in which the Young's modulus of the super-hard material is relatively high, or in which the strength of the super-hard material is relatively high, may exhibit enhanced robustness in use.

In one embodiment of the invention, the support body may comprise cemented tungsten carbide material or comprise or consist essentially of a super-hard material. In some embodiments, the support body may have an mean Young's modulus of at least about 60%, at least about 70%, at least about 80% or at least about 90% that of the super-hard material. In one embodiment, the average Young's modulus of the support body is in the range of about 60% to 80% that of the super-hard material. Such embodiments may have the advantage of reduced risk of fracture of the super-hard structure.

In some embodiments of the invention, the PCD material may have an interstitial mean free path in the range from about 0.05 micron to about 1.3 microns, in the range from about 0.1 micron to about 1 micron, or in the range from about 0.5 micrometers to about 1 micron; and the standard deviation of the mean free path may be in the range from about 0.05 micron to about 1.5 microns, or in the range from about 0.2 micron to about 1 micron. Such embodiments of PCD material may exhibit enhanced structural homogeneity and strength.

In some embodiments of the invention, the PCD material may have a mean diamond grain contiguity of at least about 60 percent or in the range from 60.5 percent to about 80 percent. Such embodiments of PCD material may exhibit enhanced stiffness and strength.

In some embodiments of the invention, the PCD cutting structure is formed of PCD material comprising diamond grains having mean size of at most about 20 microns, at most about 10 microns, at most about 7 microns or even at most about 5 microns. In some embodiments, the PCD material may comprise diamond grains having mean size of at least about 0.1 microns.

Embodiments of the invention have the advantage that the super-hard structure may be selected and provided independently of the support body, and robustly secured to the support body prior to mounting the cutter insert onto a drill bit body. Embodiments of the invention may have the additional advantage that retention of the super-hard structure within the cutter insert does not need to rely on a locking mechanism, for which the shape of the super-hard structure may need to be specially adapted or modified.

Certain embodiments of the invention may have the further advantage that the super-hard structure can be released for re-use by unclamping it from the support body if the support body becomes worn away in use, and may be clamped to a different support body. Since super-hard structures may be relatively expensive to manufacture certain embodiments of the invention may permit them to be used more cost-effectively.

Certain embodiments comprising two or more super-hard structures may have the advantage that relatively small super-hard structures may be used instead of a single relatively large super-hard structure. Super-hard structures comprising PCD material sintered by a method including subjecting an aggregate mass of diamond particles to a pressure of at least about 6.0 GPa, at least 6.5 GPa, at least about 7.0 GPa or at least about 8.0 GPa may tend to be relatively small since the volume of the reaction vessel may need to be small in order to generate such high pressures. It may be preferable to use PCD material produced at such pressures because such PCD material may tend to be stronger than PCD produced at lower pressures, such as pressures in the range between about 5 GPa and 6 GPa.

An aspect of the invention provides a drill bit for boring into the earth, adapted for receiving and accommodating an embodiment of a cutter insert according to the invention. In one embodiment of the invention, the drill bit may comprise a drill bit body comprising a recess configured for receiving an embodiment of a cutter insert according to the invention.

DRAWINGS

Non-limiting embodiments of the invention will now be described with reference to the accompanying drawings of which FIG. 1A shows a perspective view of an embodiment of a cutter insert. FIG. 1B shows a plan view of an embodiment of the cutter insert. FIG. 1C and FIG. 1D show cross-sectional views of two versions of the cutter insert, the cross-section corresponding to the plane indicated by A-A in FIG. 1B.

FIG. 2A shows a perspective view of an embodiment of a cutter insert shown with a portion cut-away to display internal features. FIG. 2B shows a different perspective view of the embodiment shown in FIG. 2A. FIG. 2C shows a plan view of the embodiment shown in FIG. 2A and FIG. 2B, and FIG. 2D shows a longitudinal cross-section view diametrically through the embodiment along the plane A-A shown in FIG. 2C.

FIG. 6 shows a perspective view of an embodiment of a cutter insert.

FIGS. 7A and 7B show, respectively, a perspective view, and an expanded view of an embodiment of a drill bit body having embodiments of cutter inserts mounted thereon.

The same reference numbers refer to the same general features in all drawings.

DETAILED DESCRIPTION OF EMBODIMENTS

Figure 1A:
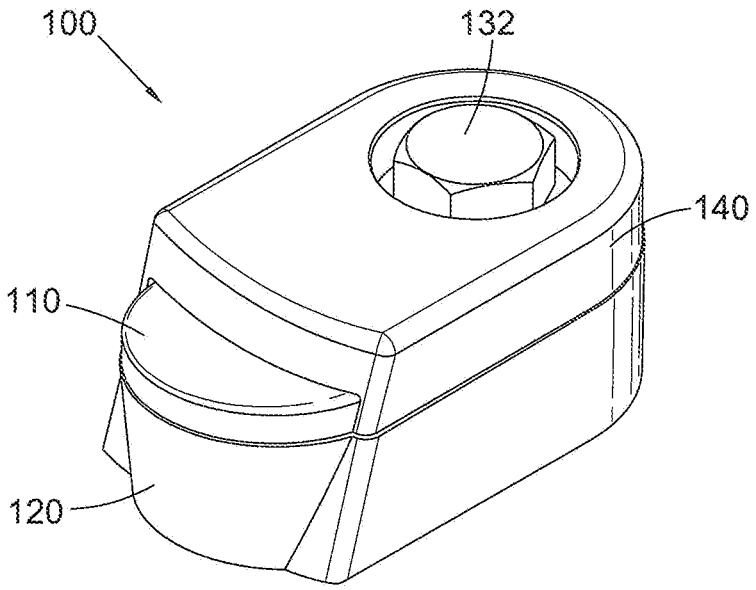

As used herein, a "super-hard structure" comprises a super-hard material. As used herein, a "super-hard material" has a Vickers hardness of at least about 28 GPa. Diamond, cubic boron nitride (cBN), polycrystalline diamond material (PCD) and polycrystalline cubic boron nitride material (PCBN) are examples of super-hard materials. As used herein, PCD material comprises a mass of diamond grains, a substantial portion of which are directly inter-bonded with each other and in which the content of diamond is at least about 80 volume percent of the material. In one embodiment of PCD material, interstices between the diamond grains may be at least partly filled with catalyst material for diamond. As used herein, "interstices" or "interstitial regions" are regions between the diamond grains of PCD material. In embodiments of PCD material, interstices or interstitial regions may be substantially or partially filled with a material other than diamond, or they may be substantially empty. Embodiments of PCD material may comprise at least a region from which catalyst material has been removed from the interstices, leaving interstitial voids between the diamond grains.

When embodiments of cutter inserts according to the invention are in the clamped condition, the clamp mechanism directly or indirectly exerts a compressive force on at least a part of the super-hard structure to secure it in place in relation to the support body, even when the cutter insert is not mounted onto a drill bit body. Embodiments of cutter inserts according to the invention are self-supporting when in the clamped condition, which means that the super-hard structure is gripped in place against the support body by the clamp mechanism even when the cutter insert is detached from a drill bit body or other tool carrier. When the cutter insert is in the clamped condition, lateral movement of the super-hard structure relative to the support body may be resisted or prevented by the load applied by the clamp mechanism and frictional forces between the super-hard structure and the support body or by other means.

With reference to FIG. 1A, FIG. 1B, FIG. 1C and FIG. 1D, an embodiment of a cutter insert 100 for a drill bit (not shown) for boring into the earth, comprises a super-hard structure 110 clamped to a support body 120 by means of a clamp mechanism 130; the clamp mechanism 130 comprising opposed laterally extending compression members 132 and 134 connected by an elongate longitudinal tension member 136 capable of sustaining a clamping force between the compression members 132 and 134. In this example embodiment, the clamp mechanism comprises a nut and bolt assembly, in which the bolt head 132 and nut 134 function as compression members 132 and 134, respectively, and a shaft 136 of the bolt functions as the tension member. This example embodiment further comprise an intermediate compression member 140 disposed between compression member 132 and the super-hard structure 110, and functions to transmit a compressive force generated by compression member 132 onto the super-hard structure 110. The tension member 136 may be disposed within an internal passage within the cutter insert 100 and formed cooperatively by respective through-holes within the intermediate compression member 140 and the support body 120.

In this embodiment, the intermediate compression member 140 extends over the top and the side of the super-hard structure 110, past the centre of the super-hard structure 110, thus securing it against lateral displacement.

In the embodiment described with reference to FIG. 1A, FIG. 1B, FIG. 1C and FIG. 1D, the cutter element may be assembled by placing the super-hard structure 110 onto the support body 120 as illustrated, placing the intermediate compression member 140 over the super-hard structure 110 and the support body 120 with the corresponding respective internal passages aligned, inserting the shaft 136 of the bolt through the internal passage and fastening the nut 134 onto the threaded end of the bolt shaft 136. Tightening the nut 134 will cause compressive members 132 and 134 to generate a compressive force between them, and consequently between the intermediate compressive member 140 and the support body 120, thereby clamping the super-hard structure 110 onto the support body to provide a robust, self-supporting cutter insert 100, which may be mounted onto a suitably adapted drill bit body (not shown). In the clamped condition, the compressive forces generated by the compression members 132 and 134 will be balanced by a corresponding tensile stress maintained by the tension member 136. In this example embodiment, the super-hard structure 110 is releasably clamped to the support body 120 and may be removed by loosening the nut 134.

Figure 1B:
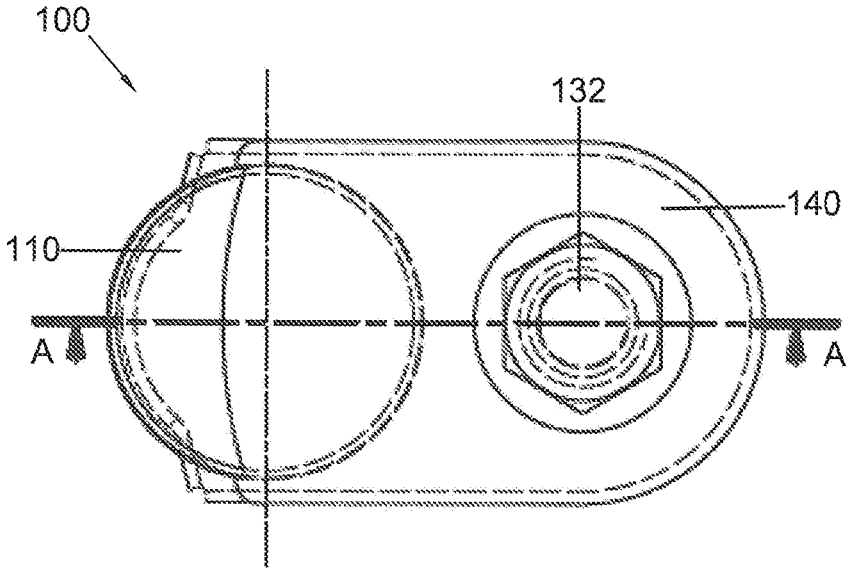
Figure 1C:
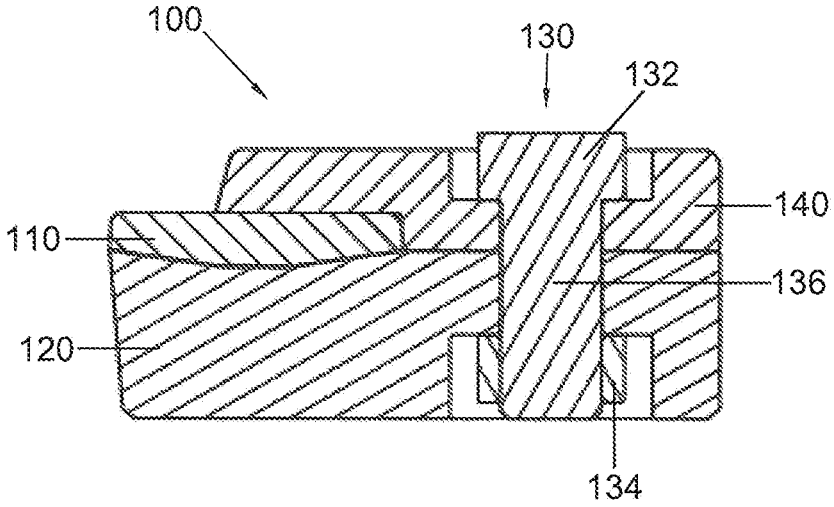
Figure 1D:
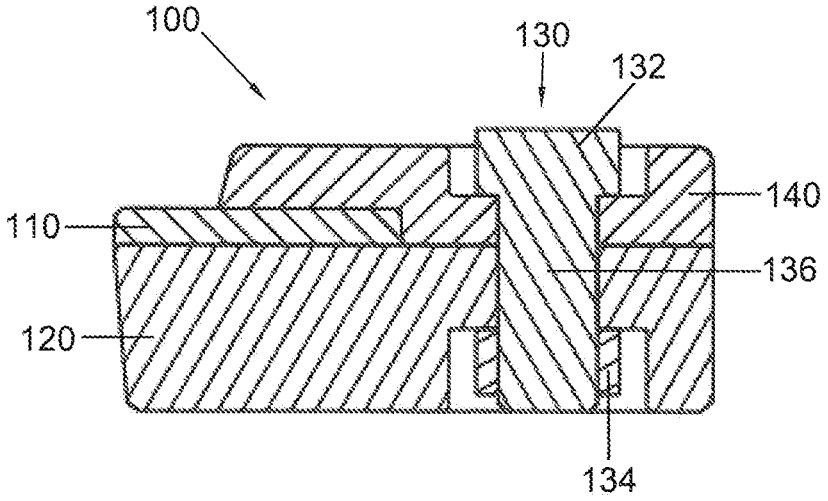
Figure 2A:
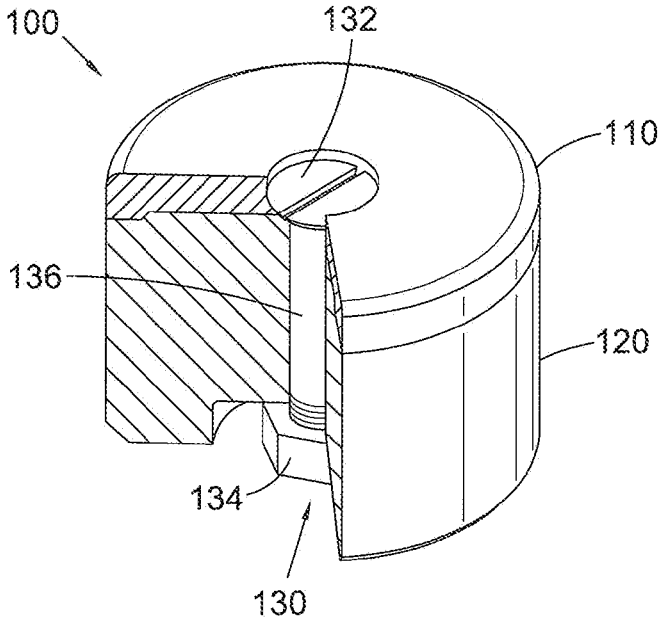
Figure 2B:
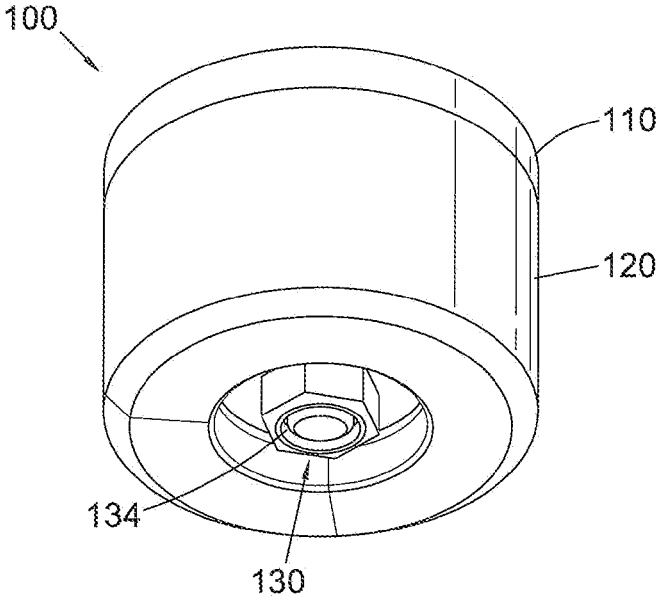
Figure 2C:
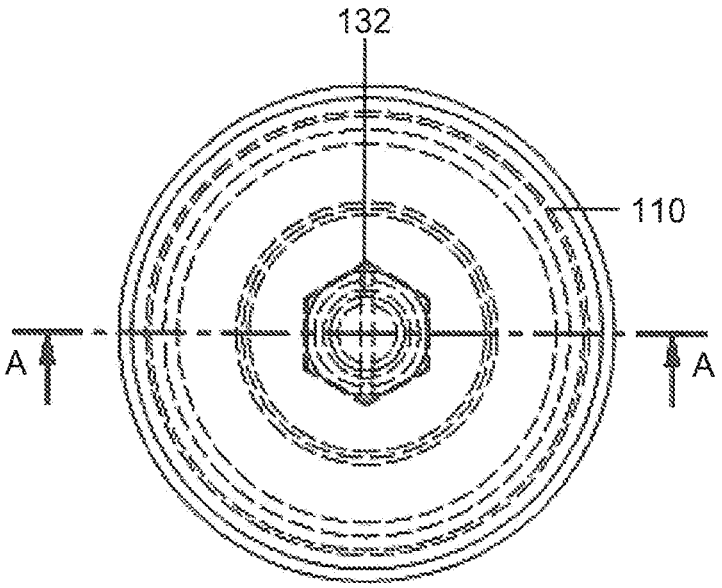
Figure 2D:
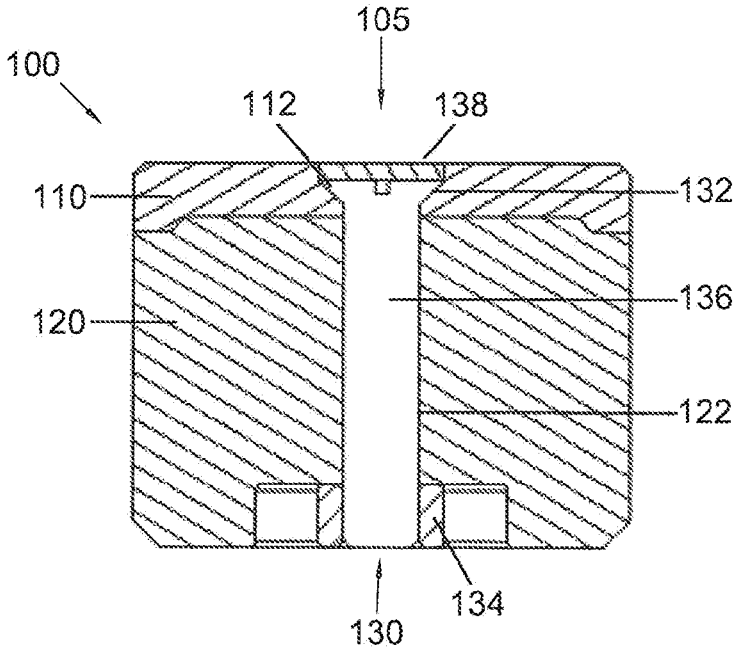

In a version of the embodiment of a cutter insert 100 shown in FIG. 1C, the interface between the super-hard structure 110 and the support body 120 may be non-planar. As a non-limiting example, the support body 120 and the super-hard structure 110 may be configured with respective cooperating boss and recess. This may have the advantage of facilitating the location of the super-hard structure 110 and resisting or preventing lateral movement or rotation of the super-hard structure 110 relative to the support body 120 in use.

As used herein, a "rake face" of a tool is the surface or surfaces over which the chips flow when the tool is used to remove material from a body, the rake face directing the flow of newly formed chips. As used herein, "chips" are the pieces of a body removed from the work surface of the body by a machine tool in use.

In the example embodiment 100 shown in FIG. 2A, FIG. 2B, FIG. 2C and FIG. 2D, the clamp mechanism 130 may comprise a nut and bolt assembly, in which the bolt head 132 and nut 134 function as compression members and a shaft 136 of the bolt functions as the tension member. The shaft 136 is disposed within an internal passage formed cooperatively by aligned respective through-holes 112 and 122 within the super-hard structure 110 and the support body 120, respectively. Tightening the nut 134 will cause compression members 132 and 134 to generate a compressive force between them, thereby clamping the super-hard structure 110 to the support body 120. The super-hard structure 110 may be removed by loosening the nut 134. This embodiment comprises a wear resistant element 138 comprising PCD material, which is attached to the cutter insert 100 over the compression member 132 on the rake face 105 of the cutter insert 100 to protect the compression member 132 against wear in use (the wear resistant element 138 is not shown in FIG. 2A and FIG. 2C in order better to display the compression element 132). The through-hole 112 is countersunk and configured to accommodate both the compression member 132 and the wear-resistant element 138, which may be in the general form of a circular plug.

Figure 3A:
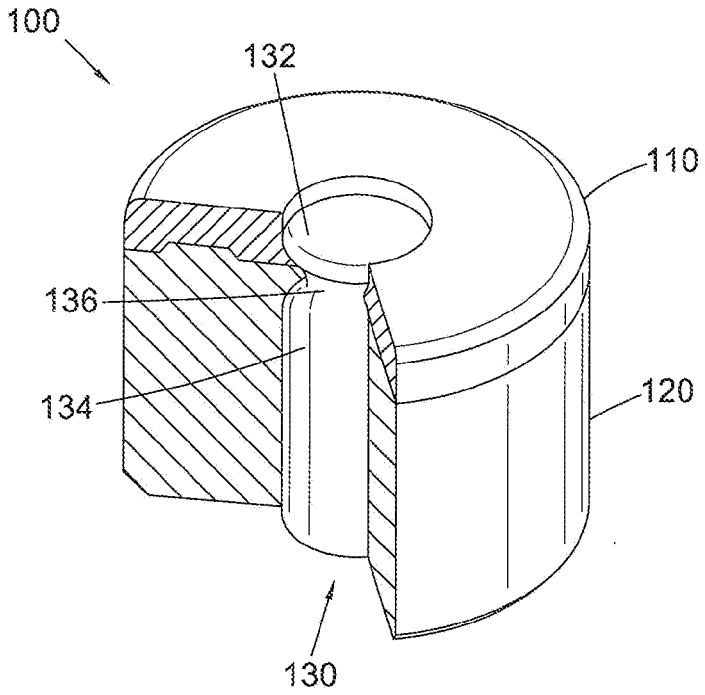
FIG. 3A shows a perspective view of an embodiment of a cutter insert shown with a portion cut-away to display internal features.
Figure 3B:
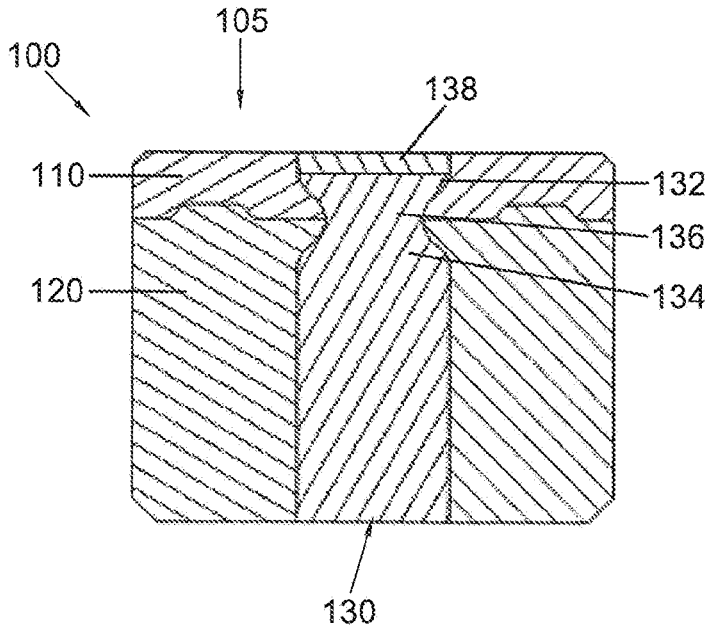
FIG. 3B shows a longitudinal cross-section view diametrically through the embodiment shown in FIG. 3A.
Figure 4A:
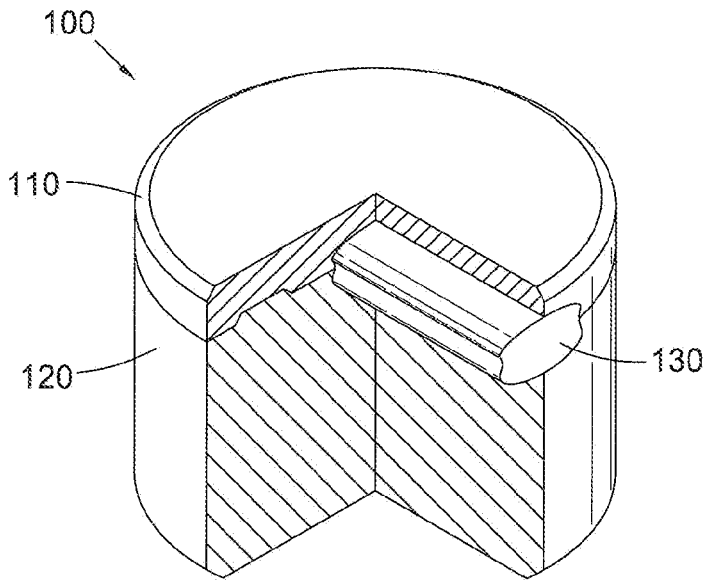
FIG. 4A shows a perspective view of an embodiment of a cutter insert shown with a portion cut-away to display internal features.
Figure 4B:
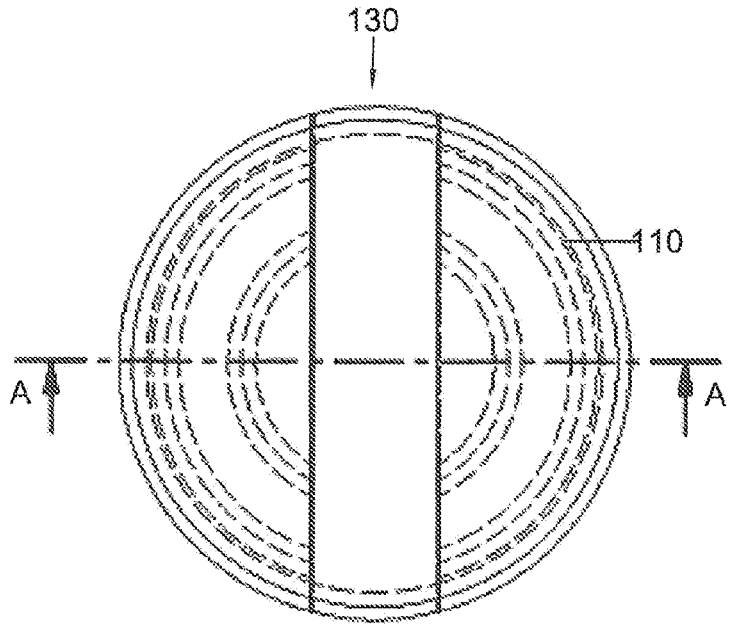
FIG. 4B shows a plan view of the embodiment shown in FIG. 4A.
Figure 4C:
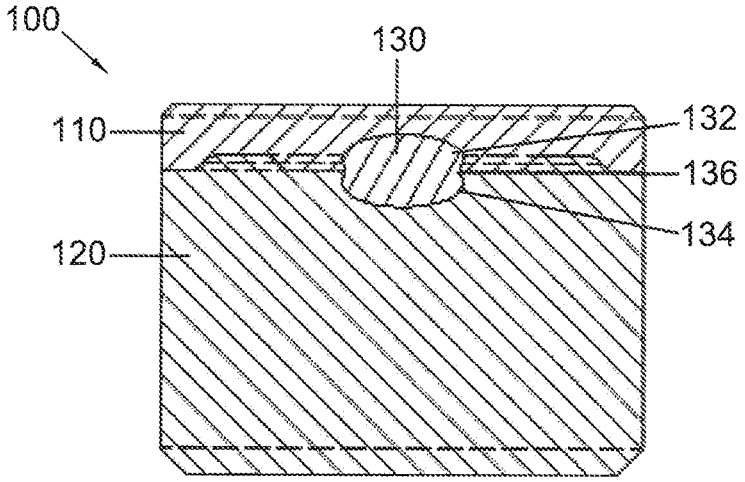
FIG. 4C shows a longitudinal cross-section view diametrically through the embodiment along the plane A-A shown in FIG. 4B.

In the respective example embodiments 100 shown in FIG. 3A and FIG. 3B, and in FIG. 4A, FIG. 4B and FIG. 4C, the clamp mechanism comprises a pin or beam 130 having a pair of laterally extending compression members 132 and 134 in the form of ridges or lips integrally connected by a neck 136, which functions as a tension member. The pin 130 is disposed within an internal passage formed cooperatively by aligned respective holes or recesses within the super-hard structure 110 and the support body 120. The super-hard structure 110, the support body 120 and the pin 130 may be configured to permit the pin 130 to be inserted laterally into the passage configured to receive it, causing the super-hard structure 110 and the support body 120 to be longitudinally "pinched" together between the laterally extending portions 132 and 134 of the pin 130. Once inserted into the passage, the pin 130 may be laterally secured by various means, such as brazing a lateral member (not shown) to the support body 120 to prevent the pin 130 from becoming laterally displaced from the passage. In one version of the embodiment shown in FIG. 3A and FIG. 3B, the pin 130 may be aligned longitudinally with respect to the support body 120 and the super-hard structure 110 and in another version of the embodiment shown in FIG. 4A, FIG. 4B and FIG. 4C, the pin 130 may be substantially laterally aligned. The embodiment described with reference to FIG. 3A and FIG. 3B comprises a wear resistant element 138 comprising PCD material, which is attached to the cutter insert 100 over the compression member 132 on the rake face 105 of the cutter insert 100 to protect the compression member 132 against wear in use (the wear resistant element 138 is not shown in FIG. 3A in order better to display the compression element 132).

In one embodiment, the clamp mechanism or intermediate compression member may be configured for functioning as a chip breaker when in use, and may cause pieces of material removed from a body of rock by the action of the cutter insert to be broken into smaller units for ease of removal.

Figure 5A:
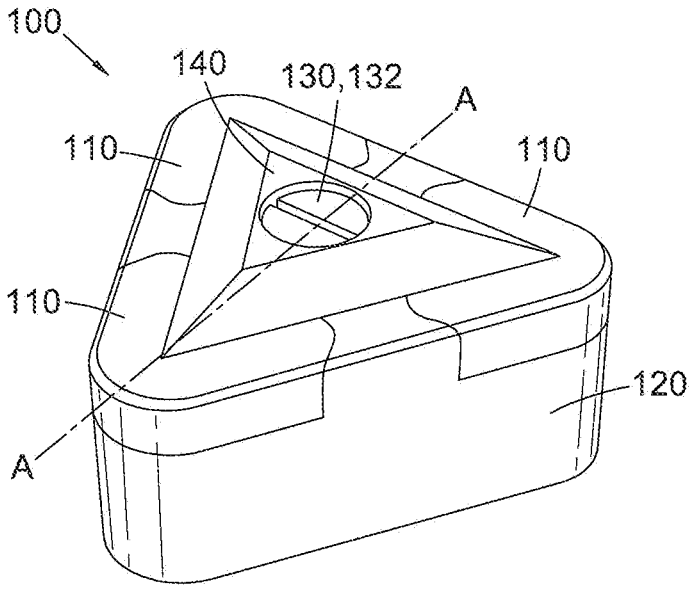
FIG. 5A shows a perspective view of an embodiment of a cutter insert shown with a portion cut-away to display internal features.
Figure 5B:
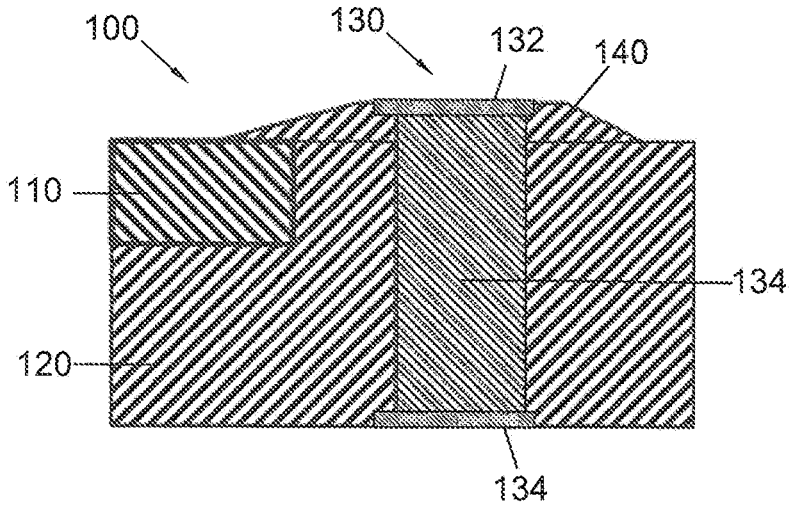
FIG. 5B shows a longitudinal cross-section view diametrically through the embodiment shown in FIG. 5A along the plane indicated by A-A.

With reference to FIG. 5A and FIG. 5B, an embodiment of the invention comprises a cutter insert 100 for a drill bit (not shown) for boring into the earth, comprising three super-hard structures 110 clamped to a generally triangular support body 120 (when viewed in a plan view) at three respective tips by means of a clamp mechanism 130. The clamp mechanism 130 comprises opposed laterally extending compression members 132 and 134 connected by a longitudinal tension member 136. In this example embodiment, the clamp mechanism comprises a nut and bolt assembly, in which the bolt head 132 and nut 134 function as compression members 132 and 134, respectively, and a shaft 136 of the bolt functions as the tension member. This embodiment further comprises an intermediate compression member 140 disposed between compression member 132 and all three of the super-hard structures 110 and functions to transmit a compressive force generated by compression member 132 onto the two or more super-hard structures 110. The tension member 136 is disposed within an internal passage through the intermediate compression member 140 and the support body 120. The intermediate compression member 140 has a generally frusto-pyramidal shape, presenting a raised rake surface, and may function as a chip breaker in use.

With reference to FIG. 6, an embodiment of the invention comprises a cutter insert 100 for a drill bit (not shown) for boring into the earth, comprising four super-hard structures 110 clamped to a generally four-sided support body 120 (when viewed in a plan view) at four respective tips by means of a clamp mechanism 130. The clamp mechanism 130 comprises opposed laterally extending compression members 132 and 134 connected by a longitudinal tension member 136. In this example embodiment, the clamp mechanism comprises a nut and bolt assembly, in which the bolt head 132 and nut 134 function as compression members 132 and 134, respectively, and a shaft 136 of the bolt functions as the tension member. This embodiment comprises an intermediate compression member 140 disposed between compression member 132 and all four super-hard structures 110, for transmitting a compressive force generated by compression member 132 onto the super-hard structures 110. The tension member 136 may be disposed within an internal passage formed cooperatively by respective through-holes within the intermediate compression member 140 and the support body 120. The intermediate compression member 140 has a generally domed shape, presenting a raised surface and may function as a chip breaker in use.

In embodiments of the invention, the cutter insert is configured so that the super-hard structure or structures has or have an exposed surface or surfaces for cutting. In some embodiments, a compression member or intermediate compression member may be applied to only a portion of the super-hard structure, the clamped portion, and may not be directly in contact with another portion, the working portion, thus leaving a working surface of the working portion exposed for cutting. In another embodiment, a compression member or intermediate compression member may be applied to substantially an entire surface of the super-hard structure, and in some embodiments a compression member or intermediate compression member may partially wear away in use, exposing a portion of the super-hard structure for cutting.

With reference to FIGS. 7A and 7B, these figures show an embodiment of a drill bit body for boring into the earth, onto which are mounted a plurality of cutter inserts 100 of a kind described above with reference to FIG. 1A, FIG. 1B, FIG. 1C and FIG. 1D.

In one embodiment of the invention, a compliant shim may be placed between the super-hard structure and the support body, which may have the advantage of accommodating any topographical mismatch between the super-hard structure and the support body, which may reduce stress in the super-hard structure that may be induced by the mismatches.

In some embodiments of the invention, the super-hard structure may be clamped to the support body with sufficient force that the structure is secured to the support body with a force equivalent to a bond having a shear strength of at least about 100 MPa, more preferably at least about 150 MPa and yet more preferably at least about 200 MPa.

In some embodiments, the super-hard structure may be unbonded or merely weakly bonded to the support body at an interface between the super-hard structure and the support body. Where the super-hard structure is bonded to the support body at an interface, the bond may have a shear strength greater than about 10 MPa and less than about 500 MPa, more preferably less than about 300 MPa, yet more preferably less than about 200 MPa and yet more preferably less than about 100 MPa.

In one embodiment of the invention, the interface between the super-hard structure and the support body may be configured to resist or prevent the rotation of the super-hard structure relative to the support body when in the clamped condition. This may have the advantage of reducing the compressive force required to be applied to the super-hard structure to prevent it from rotating or becoming otherwise displaced in used. As non-limiting examples, this may be achieved by complementary ridges or projections and recesses formed on the super-hard structure and support body, or by some other configuration that may resist rotation of the super-hard structure. Since super-hard materials tend to be relatively brittle compared to less hard materials, reduction in a compressive force applied to a part of the super-hard structure may have the advantage of reducing the risk of it fracturing when the clamp mechanism is applied to it or in use.

In one embodiment, the support body may comprise super-hard material in granular or particulate form. In some versions of this embodiment, the support body may comprise diamond or cBN grains. In one embodiment, the support body may comprise PCD. The presence of super-hard material in the support body may have the effect of increasing the mean Young's modulus.

Embodiments of the invention in which the super-hard structure and the support body are particularly stiff and strong may be particularly robust and resistant to fracture. The stiffness of a structure is related to the Young's modulus of the material of which the structure is comprised. Young's modulus is a type of elastic modulus and is a measure of the uniaxial strain in response to a uniaxial stress, within the range of stress for which the material behaves elastically. The Young's modulus of a material may be calculated from the measured longitudinal and transverse speed of sound through it, as is well known in the art.

Herein, the size of grains, such as diamond grains, is expressed in terms of equivalent circle diameter (ECD), which is the diameter of a circle having the same area as a cross section through the particle. The ECD size distribution and mean size of a plurality of particles may be measured for individual unbonded grains or for grains bonded together within a body, by means of image analysis of a cross-section through or a surface of the body. Unless otherwise stated herein, dimensions of size, distance, perimeter, ECD, mean free path and so forth relating to grains and interstices within PCD material, as well as the grain contiguity, refer to the dimensions as measured on a surface of, or a section through a body comprising PCD material and no stereographic correction has been applied.

As used herein, a multi-modal size distribution of a mass of grains means that the grains have a size distribution that is formed of more than one peak, each peak corresponding to a respective "mode". Multimodal polycrystalline bodies are typically made by providing more than one source of a plurality of grains, each source comprising grains having a substantially different mean size, and blending together the grains from the sources.

PCD having high micro-structural homogeneity may be particularly strong. The homogeneity of the microstructure may be characterised in terms of the combination of the mean thickness of the interstices between the diamonds, and the standard deviation of the distribution of this thickness. The homogeneity or uniformity of a PCD structure may be quantified by conducting a statistical evaluation using a large number of micrographs of polished sections. The distribution of a filler phase or of pores within the PCD structure may be easily distinguishable from that of the diamond phase using electron microscopy and can be measured in a method similar to that disclosed in EP 0 974 566 (see also WO2007/110770). This method allows a statistical evaluation of the average thicknesses or interstices along several arbitrarily drawn lines through the microstructure. The mean binder or interstitial thickness is also referred to as the "mean free path". For two materials of similar overall composition or binder content and average diamond grain size, the material that has the smaller average thickness will tend to be more homogenous, as this indicates a finer scale distribution of the binder in the diamond phase. In addition, the smaller the standard deviation of this measurement, the more homogenous is the structure. A large standard deviation indicates that the binder thickness varies widely over the microstructure and that the structure is not uniform.

As used herein, the "interstitial mean free path" within a polycrystalline material such as PCD material, comprising an internal structure including interstices or interstitial regions is the average distance across each interstitial between different points at the periphery of the interstitial. The mean free path is determined by averaging the lengths of many lines drawn on a micrograph of a polished sample cross section. The mean free path standard deviation is the standard deviation of these values. The diamond mean free path is measured analogously.

In measuring the mean value and deviation of a quantity such as grain contiguity, or other statistical parameter measured by means of image analysis, several images of different parts of a surface or section are used to enhance the reliability and accuracy of the statistics. The number of images used to measure a given quantity or parameter may be at least about 9 or even up to about 36. The number of images used may be about 16. The resolution of the images needs to be sufficiently high for the inter-grain and inter-phase boundaries to be clearly made out. In the statistical analysis, typically 16 images are taken of different areas on a surface of a body comprising the PCD material, and statistical analyses are carried out on each image as well as between different images. Each image should contain at least about 30 diamond grains, although more grains may permit more reliable and accurate statistical image analysis.

In some embodiments, the super-hard structure may comprise PCD material manufactured using a method including sintering of diamond grains in an ultra-high pressure and temperature (HPHT) process in the presence of a catalyst material for diamond and then removing catalyst material from interstices within the PCD structure. In one embodiment, the diamond grains may be sintered at an ultra-high pressure of at least about 6.5 GPa and a temperature of at least about 1,500 degrees centigrade. In one embodiment, catalyst material may be removed from the PCD table using methods known in the art such as electrolytic etching, acid leaching and evaporation techniques. In some embodiments, a masking or passivating medium may be introduced into pores within the PCD structure.

In some embodiments, the PCD structure may be as taught in PCT publication number WO2007/020518, which discloses polycrystalline diamond a polycrystalline diamond abrasive element comprising a fine grained polycrystalline diamond material characterised in that it has an interstitial mean-free-path value of less than 0.60 microns, and a standard deviation for the interstitial mean-free-path that is less than 0.90 microns. In one embodiment, the polycrystalline diamond material may have a mean diamond grain size of from about 0.1 micron to about 10.5 microns.

In one embodiment, the super-hard structure may comprise PCD material in which the diamond grains have the size distribution characteristic that at least 50 percent of the grains have mean size greater than 5 microns, and at least 20 percent of the grains have mean size in the range from 10 microns to 15 microns.

As mentioned previously, the diamond grain contiguity of PCD material may be associated with the strength and stiffness of the PCD material. In the field of quantitative stereography, particularly as applied to cemented carbide material, "contiguity" is understood to be a quantitative measure of inter-phase contact. It is defined as the internal surface area of a phase shared with grains of the same phase in a substantially two-phase microstructure (Underwood, E. E, "*Quantitative Stereography*", Addison-Wesley, Reading, Mass. 1970; German, R. M. "*The Contiguity of Liquid Phase Sintered Microstructures*", Metallurgical Transactions A, Vol. 16A, July 1985, pp. 1247-1252). As used herein, "diamond grain contiguity" $\kappa$ is a measure of diamond-to-diamond contact or bonding, or a combination of contact and bonding within PCD material, and is calculated according to the following formula using data obtained from image analysis of a polished section of PCD material:

$\kappa=100*[2*(\delta-\beta)]/[(2*(\delta-\beta))+\delta]$, where $\delta$ is the diamond perimeter, and $\beta$ is the binder perimeter.

As used herein, the "diamond perimeter" is the fraction of diamond grain surface that is in contact with other diamond grains. It is measured for a given volume as the total diamond-to-diamond contact area divided by the total diamond grain surface area. The binder perimeter is the fraction of diamond grain surface that is not in contact with other diamond grains. In practice, measurement of contiguity is carried out by means of image analysis of a polished section surface. The combined lengths of lines passing through all points lying on all diamond-to-diamond interfaces within the analysed section are summed to determine the diamond perimeter, and analogously for the binder perimeter.

Embodiments of the invention are described in more detail with reference to the examples below, which are not intended to limit the invention.

EXAMPLE 1

A super-hard structure comprising PCD material may be provided, in which the PCD material comprises a multi-modal distribution of diamond grains having a mean size of at most about 15 microns. The structure may be generally disc-like, having a diameter of about 16 mm and a mean thickness of about 1.5 mm. The thickness may vary diametrically across the PCD structure, from about 1 mm thick on one side to about 2.2 mm on the opposite side. A generally cylindrical support body comprising Co-cemented tungsten carbide may be provided with an end configured to complement the varying thickness of the PCD structure (i.e. with a sloping end). Complementary central through-holes may be formed in the PCD structure and in the support body to provide a central through-passage. The edges of the hole through the PCD structure may be chamfered or bevelled in order to reduce the risk of fracture when the clamp mechanism is applied. A copper shim also having a central through-hole may be placed onto the sloping end of the support body and the PCD structure placed onto the washer to form a generally cylindrical pre-clamp assembly, in which the complementary surfaces of the PCD structure and the support body are proximate each other, separated by the copper shim. In this configuration, the interface between the PCD structure and support body, via the shim, is at an angle with respect to a lateral plane that is perpendicular to the longitudinal cylindrical axis of the cutter insert, thereby resisting the rotation of the PCD structure relative to the support body. A sufficiently long steel bolt may be inserted into the central passage and a nut may be fastened to the end of the bolt projecting from one end of passage, and tightened to clamp the PCD structure to the support body.

EXAMPLE 2

A super-hard tablet formed of PCD was prepared by sintering diamond particles together in the presence of cobalt at a pressure of 6.8 GPa. Raw material diamond powder was prepared by blending diamond grains from three sources, each source having a different average grain size distribution in order to make a multi-modal PCD. The blended diamond grains had a mean size in the range of about 15 to 20 microns. Cobalt was deposited onto the surfaces of the diamond grains by means of a method including depositing cobalt oxide onto the surfaces from an aqueous solution. The cobalt coated diamond grains were formed into an aggregated mass that was sintered onto a cemented carbide substrate at a pressure of about 6.8 GPa and a temperature of 1,550 degrees centigrade to form a compact comprising a sintered PCD structure bonded to a tungsten carbide substrate. The substrate was removed by grinding and lapping, leaving a self-supporting PCD tablet structure having a diameter of about 16 mm and thickness of about 2.2 mm. The diamond content of the PCD structure was about 92 percent by volume, the balance being cobalt and minor precipitated phases such as WC. The average interstitial mean free path of the PCD material was about 0.74 microns, with a standard deviation of about 0.62 microns, and the Young's modulus of the PCD was about 1,025 GPa.

An embodiment of a clamp mechanism described with reference to FIG. 1A, FIG. 1B and FIG. 1C may be provided. The clamped assembly would form a self-supporting, portable cutter insert which was mounted onto an earth-boring drilling bit by inserting the assembly into a recess formed into a bit body.

EXAMPLE 3

A PCD disc having thickness of about 2.2 millimetres and diameter of about 16 mm was provided. The substrate to which the PCD was bonded during the sintering step was removed by grinding and lapping, leaving an un-backed, free-standing PCD disc. The PCD comprised coherently bonded diamond grains having a multi-modal size distribution with mean equivalent circle diameter of about 9 microns, the content of diamond in the PCD material was about 91 volume percent, the interstitial mean free path was about 0.6 microns, the standard deviation of the mean free path was about 0.5 microns and the diamond grain contiguity was about 62 percent.

The PCD disc was then treated (leached) in acid to remove substantially all of the cobalt solvent/catalyst material throughout the entire PCD structure. Several additional discs, each having a diameter of about 19 mm, were made as described above and subjected to a range of tests to measure mechanical properties. The transverse rupture strength (TRS) of the PCD after leaching was about 1,070 MPa.

A cobalt-cemented tungsten carbide substrate having substantially the same diameter as the 16 mm PCD disc and an embodiment of a clamp mechanism described with reference to FIG. 1A, FIG. 1B and FIG. 1C may be provided. The clamped assembly would form a self-supporting, portable cutter insert which was mounted onto an earth-boring drilling bit by inserting the assembly into a recess formed into a bit body.

The invention claimed is:

1. A cutter insert assembly for a drill bit for boring into the earth, comprising a super-hard structure clampable to a support body by means of a clamp mechanism;

the clamp mechanism comprising opposed or opposable compression members connected or connectable by a tension member capable of sustaining a clamping force between the compression members when the cutter insert assembly is in a clamped condition, in which condition the compression members exert opposing compressive forces on the super-hard structure and the support body, operable to clamp the super-hard structure to the support body along an interface between the super-hard structure and the support body, the interface being non-planar and being configured to resist rotation or other displacement of the super-hard structure relative to the support body in the clamped condition, and in which condition the cutter insert assembly is self-supporting and capable of being mounted onto a drill bit body.

2. A cutter insert for a drill bit, consisting of a cutter insert assembly as claimed in claim 1 in the clamped condition.

3. A cutter insert as claimed in claim 2, in which the tension member is disposed within an internal passage defined by the support body.

4. A cutter insert as claimed in claim 2, in which the tension member is disposed within an internal passage defined cooperatively by the super-hard structure and the support body.

5. A cutter insert as claimed in claim 2, in which the super-hard structure is releasably clamped to the support body by a releasable clamp mechanism.

6. A cutter insert as claimed in claim 2, in which the clamp mechanism comprises an elongate longitudinal tension member having a pair of opposite ends, and a pair of opposing laterally projecting compression members each fixed or fastenable to a respective end.

7. A cutter insert as claimed in claim 2, comprising two or more spaced-apart super-hard structures clamped to the support body by means of a clamp mechanism in which a compression member or intermediate compression member clamps the two or more super-hard structures simultaneously.

8. A cutter insert as claimed in claim 7, the cutter insert having a rake face, wherein the intermediate compression member on the rake face of the cutter insert comprises a material having hardness of at least about 60 HRA Rockwell.

9. A cutter insert as claimed in claim 7, in which the intermediate compression member comprises carbide material.

10. A cutter insert as claimed in claim 2, the cutter insert having a rake face, wherein the compression member on the rake face of the cutter insert comprises a material having hardness of at least about 60 HRA Rockwell.

11. A cutter insert as claimed in claim 2, in which the compression member comprises carbide material.

12. A cutter insert as claimed in claim 2, the cutter insert having a rake face, and a wear resistant element comprising a super-hard material is attached to the cutter insert over the compression member on the rake face.

13. A cutter insert as claimed in claim 2, in which the super-hard structure comprises PCD material.

14. A cutter insert as claimed in claim 13, in which the PCD material has an interstitial mean free path in the range from about 0.05 micron to about 1.3 microns; and the standard deviation of the mean free path is in the range from about 0.05 micron to about 1.5 microns.

15. A cutter insert as claimed in claim 13, in which the PCD material has a mean diamond grain contiguity of at least about 60 percent.

16. A cutter insert as claimed in claim 13, in which the PCD material comprises diamond grains having mean size of at most about 20 microns.

17. A drill bit for boring into the earth, adapted for receiving and accommodating an embodiment of a cutter insert as claimed in claim 13.

18. A cutter insert as claimed in claim 2, in which the support body has an mean Young's modulus of at least about 60% that of the super-hard structure.

* * * * *